United States Patent [19]

Reggia

[11] 4,115,783

[45] Sep. 19, 1978

[54] BROADBAND HYBRID MONOPOLE ANTENNA

[75] Inventor: Frank Reggia, Bethesda, Md.

[73] Assignee: The United States of America as represented by the Secretary of the Army, Washington, D.C.

[21] Appl. No.: 806,575

[22] Filed: Jun. 14, 1977

[51] Int. Cl.[2] ..... H01Q 9/44

[52] U.S. Cl. ..... 343/792; 343/830; 343/895

[58] Field of Search ..... 343/790, 791, 792, 829–831, 343/846, 847, 895

[56] References Cited

U.S. PATENT DOCUMENTS

| | | | |
|---|---|---|---|
| 2,487,567 | 11/1949 | Lindenblad | 343/791 |
| 2,512,704 | 6/1950 | Willoughby | 343/791 |
| 2,613,319 | 10/1952 | Lisbin et al. | 343/895 |

*Primary Examiner*—Eli Lieberman

*Attorney, Agent, or Firm*—Nathan Edelberg; Robert P. Gibson; Saul Elbaum

[57] ABSTRACT

A new type of radiating structure with rugged high frequency design comprising essentially a single hybrid monopole which utilizes capacitive coupling from a open-ended transmission line to accomplish its broadband characteristics. The monopole is a metal conductor concentric with the transmission line and is separated from a ground plane by an adjustable gap that may be effectively used for fine tuning the antenna. By utilizing helical springs as the conductors this hybrid monopole antenna has self-erecting or pop-up design capability.

12 Claims, 5 Drawing Figures

BROADBAND HYBRID MONOPOLE ANTENNA

RIGHTS OF THE GOVERNMENT

The invention described herein may be manufactured, used, and licensed by or for the U.S. Government for governmental purposes without the payment to me of any royalty thereon.

BACKGROUND OF THE INVENTION

This invention is in the field of monopole antennas and more specifically is related to single hybrid floating monopoles which utilizes distributed capacitive coupling to achieve its broadband characteristics.

This hybrid monopole antenna is a new type of radiating structure which, although structured very similarly to the fundamental monopole antenna, radiates very similarly to a typical dipole antenna. This is because the monopole structure itself is capacitively coupled to the transmission line and thus in a sense is "floating". The simplicity of structure make it adaptable for many applications. One envisioned is that of a collapsible type antenna design which has the capability of being deployed automatically. Automatic deployment of antennas is particularly useful for military operations in hostile environments and hazardous radiation zones.

SUMMARY AND OBJECTS OF THE INVENTION

Therefore, one object of this invention is to provide a VHF antenna which has broadband characteristics.

Another object of this invention is to provide a hybrid monopole antenna that can be fine tuned by adjusting its distributed capacitance.

A further object of this invention is to provide a collapsible type antenna with a capability of being deployed automatically.

Yet another object of this invention is to provide a hybrid floating monopole with rugged design.

A still further object of this invention is to provide an antenna design which includes compact storage, light weight and relatively low fabrication costs.

Still another object of this invention is to provide a VHF antenna that can be utilized in hostile environments and hazardous radiation zones.

The foregoing and other objects of this invention are attained in accordance with one aspect of the present invention through the provision of a radiating monopole less than ¼ electrical wavelength long serving as the outer conductor for an open-ended coaxial transmission line which is part of the broadband impedance matching structure. The radiating monopole is capacitively coupled to the transmission line, and fine tuning can be achieved by adjusting the distance between a flange at the base of the monopole and an included ground plane. This design can easily be converted to a collapsible pop-up type antenna which could have many applications.

BRIEF DESCRIPTION OF THE DRAWINGS

The above and further objects and novel features of the invention will more fully appear from the following description when the same is read in connection with the accompanying drawings in which.

DESCRIPTION OF THE PREFERRED EMBODIMENT

Figure 1:
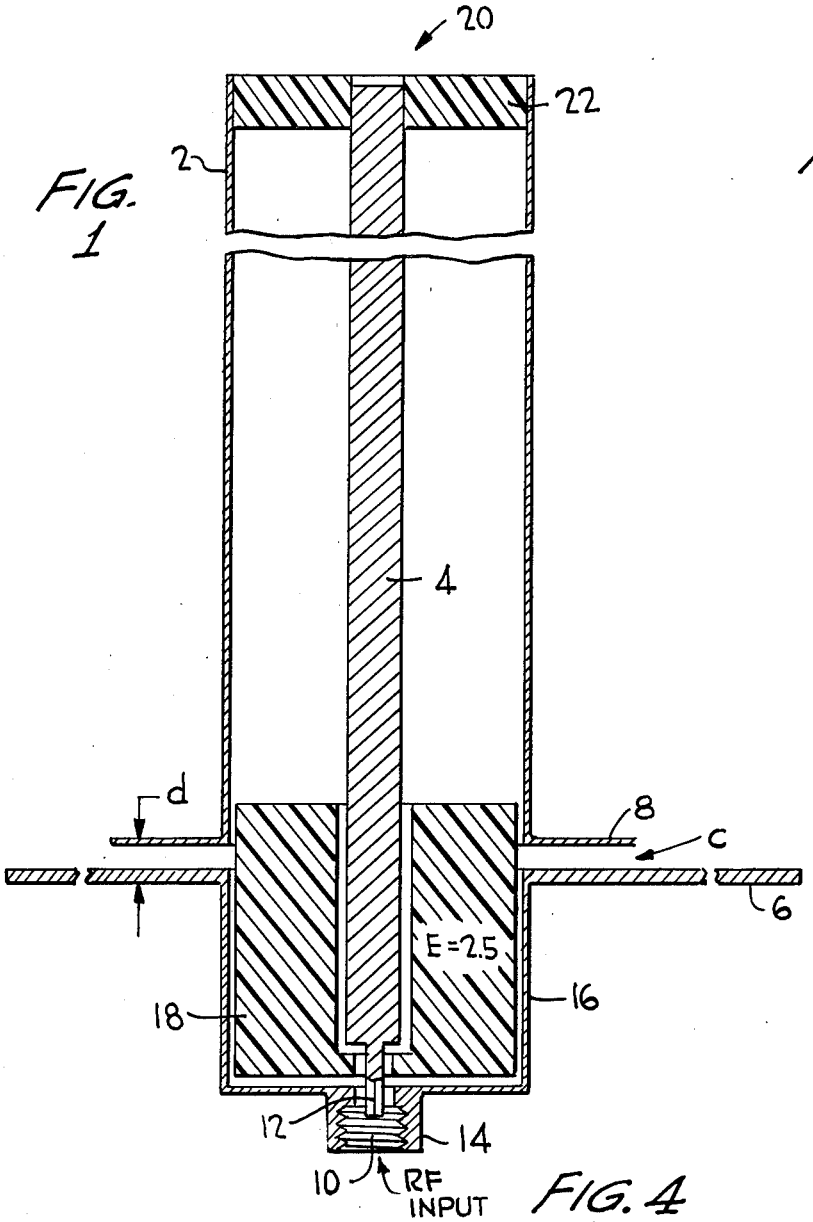
FIG. 1 illustrates schematically a cross sectional, plan view of the broadband hybrid monopole showing the basic elements of the invention.

FIG. 1 illustrates a simplified version of the hybrid monopole which makes use of distributed capacitive coupling to a main transmission line to accomplish its broadband characteristics. Fundamentally, the antenna comprises floating monopole 2 which is capacitively coupled to second monopole 4 inside the first. The radiating monopole 2 which is less than ¼ wavelength in length is in this embodiment a hollow metal cylindrical conductor which is concentric about the solid metal inner conductor monopole 4. At the input end of the floating monopole capacitance C to ground 6 is used to establish the broadband low input impedance required by the source. In this case a capacitance is created by leaving an air gap between monopole flange 8 at the base of the floating monopole and metal ground plane 6. The antenna is fed by a typical coaxial feed 10 with center conductor 12 of the input feed energizing the inner conductor 4 and outer conductor 14 going to metal ground plane 6 through cylindrical conductor 16. In this embodiment the antenna is made rigid by placing dielectric spacer (cap) 22 at open end 20 of the antenna. The antenna can be further ruggedized by filling air gap C between the monopole flange and ground plane with a solid dielectric material.

The operation of this antenna can be viewed as an open-ended coaxial transmission line. The radiating monopole, therefore, also serving as the outer conductor for the open-ended transmission line which is part of the broadband impedance matching structure. The rf input is through a coaxial transmission line ($z = 50$ ohm) at the bottom 10 and continuing up through the floating monopole 2.

The relative dimensions of the antenna are, of course, a function of desired operational frequencies and impedance considerations. For example, for one prototype, whose $f_o = 220$ MHz, the floating monopole measures 1 ⅜ inches in diameter and 15 inches in length. The center conductor of ½ inch diameter measures approximately 17 inches in length. A 2 by 2 foot square metal ground plane is found sufficient for this portotype model at 200 MHz which is ruggedized by using a dielectric with an $\epsilon$ of 2.5. The ½-power impedance bandwidth for this single capacitively coupled monopole is approximately 140 MHz which gives it a bandwidth of greater than 60 percent. Of course, these dimensions are certainly not critical and are matter of design choice.

Figure 2:
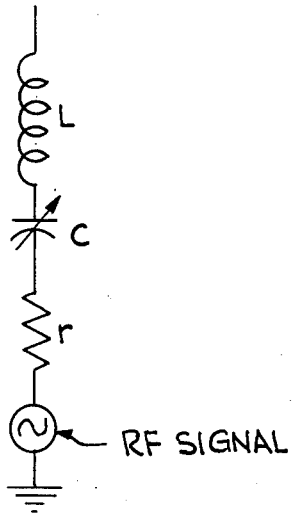
FIG. 2 illustrates schematically a simplified equivalent circuit diagram for the antenna configuration illustrated in FIG. 1.
Figure 3:
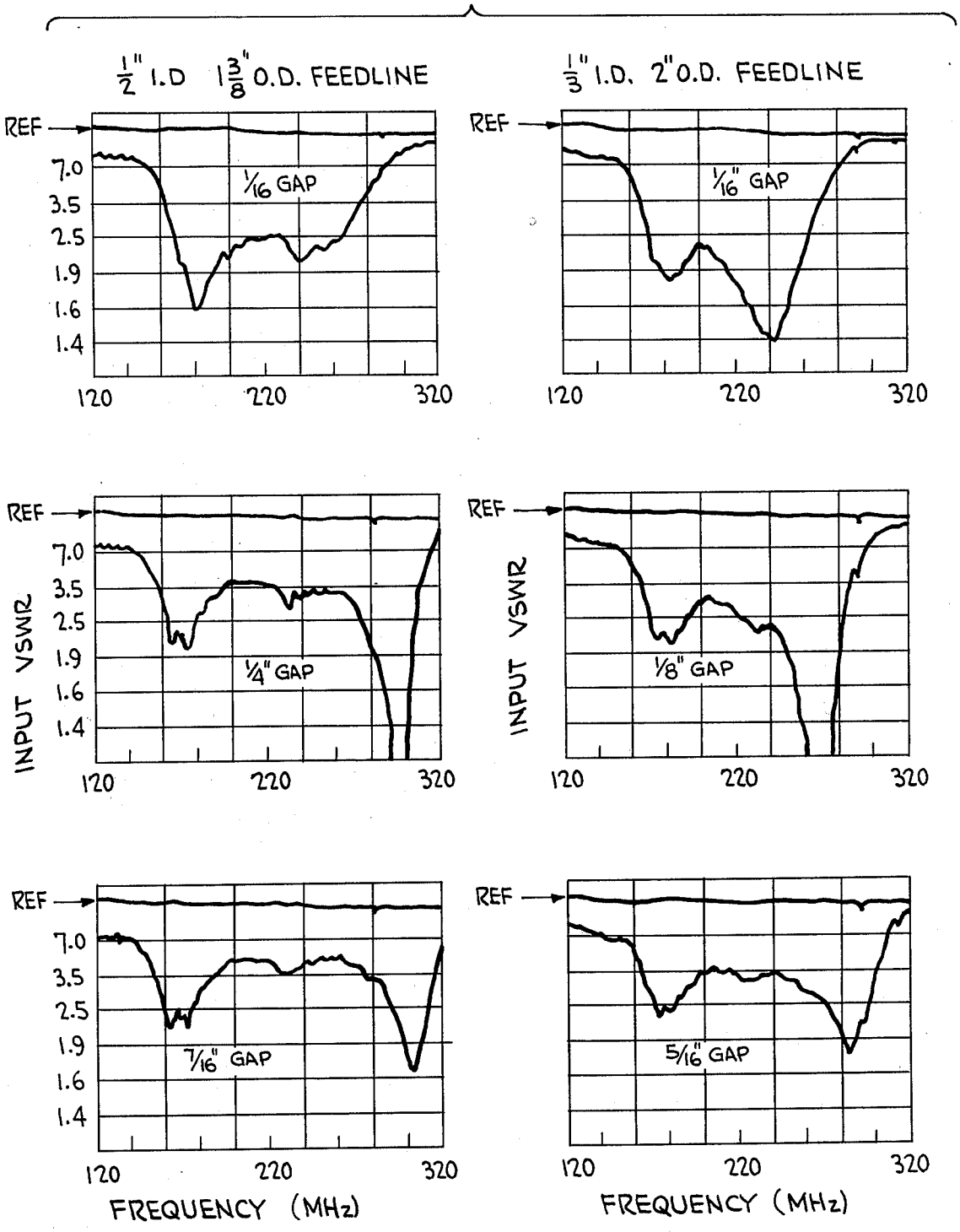
FIG. 3 illustrates graphically the bandwidth characteristics of two models of the hybrid monopole antennas wherein the variable parameter for these measurements was the air gap separating the floating monopole and the metal ground plane.

A greatly simplified equivalent circuit of the broadband hybrid monopole antenna is illustrated in FIG. 2. As can be seen it is simply an LC circuit with the capacitance being variable. Therefore, turning is simply accomplished by adjusting the distance of capacitance C between the flange at the base of the monopole and the metal ground plane. The resistance r represents the sum of the dissipative loss and radiation resistance of the antenna. The bandwidth characteristics over the 120 to 320 MHz frequency range of two test models with floating monopole lengths of 15 inches are shown in FIG. 3. The three curves at the left were obtained with a $1\frac{3}{8}$-inch diameter floating monopole while the curves at the right were obtained with a 2-inch diameter monopole. The variable parameter for each of these measurements was the air gap d separating the floating monopole and the metal ground plane. The magnitude of the input VSWR is given at the left. As seen on the graphs, as d increases the bandwidth increases. Of course, there is a trade off with the magnitude of the VSWR also increasing. As seen in these results, an instantaneous operating bandwidth of greater than 60 percent is feasible with this particular antenna design.

Figure 4:
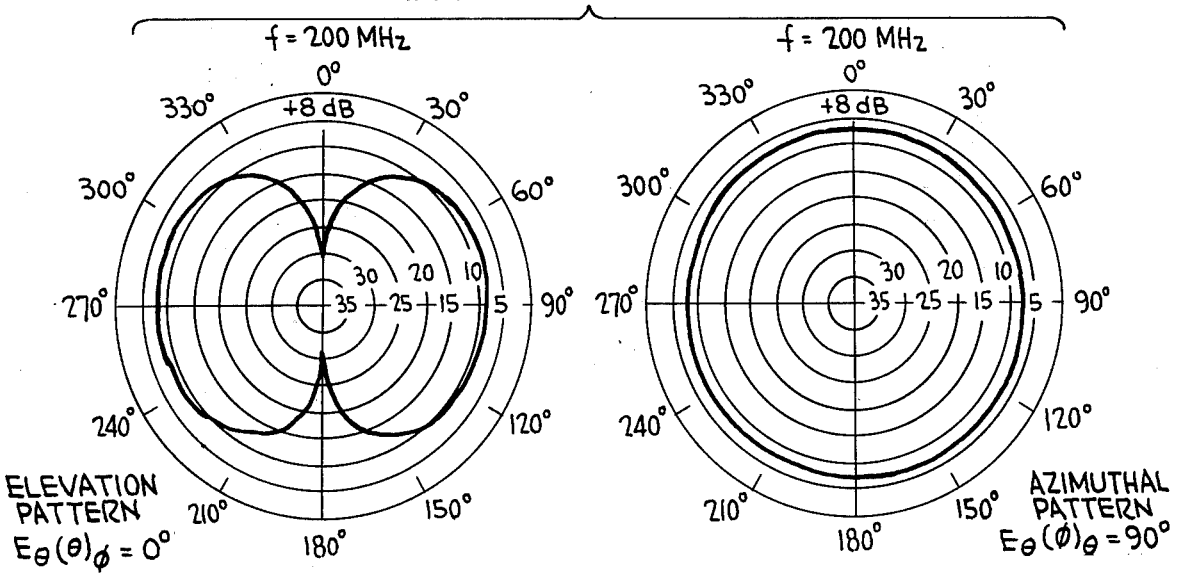
FIG. 4 illustrates graphically the far-field radiation patterns for the hybrid monopole antenna.

FIG. 4 illustrates graphically the far-field radiation patterns of the hybrid monopole antenna. The elevation pattern is given at the left, and the omnidirectional azimuthal pattern taken in a plane perpendicular to the axis of the monopole is illustrated on the right. These patterns are similar to those obtained for a dipole antenna. A gain of 1 dB was obtained for this broadband monopole at 200 MHz.

Figure 5:
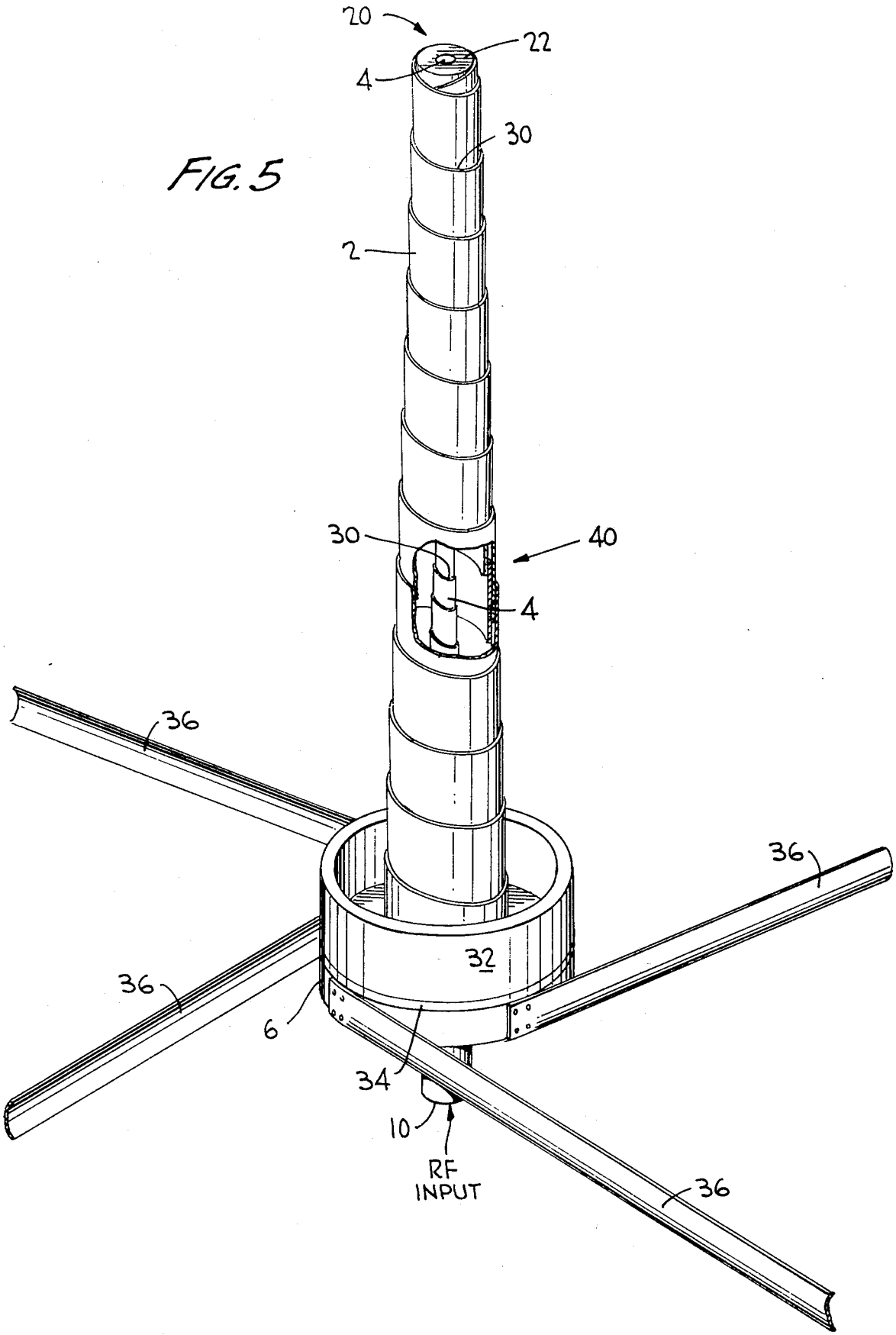
FIG. 5 illustrates graphically a plane view of one embodiment of the broadband hybrid monopole incorporating a self-erecting type of design.

FIG. 5 illustrates one embodiment of the broadband hybrid monopole antenna incorporating a self-erecting type of design, wherein like reference numerals designate corresponding parts with that of FIG. 1. The mechanism for erecting this antenna is tapered helical springs 30 with overlapping flat elements. In its compressed position the elements overlap each other to form a cylinder and retract into cylindrical disk 32. The disk also acts as part of the capacitive coupling structure, functioning much as flange 8 in FIG. 1. Capacitance C to ground 6 is used to establish the broadband low input impedance, and in this embodiment a solid dielectric material is used to ruggedize the structure and fill the gap 34. Again a dielectric spacer 22 at the top is used to cap the device.

Smaller spring 4 shown in the cutaway portion 40 of FIG. 5 acts as the inner coaxial feed line and the larger spring 2 is the outer radiating monopole. Input coupling 10 feeds the conductors similarly to coupling 10 of FIG. 1. Horizontal radials 36 are used for the antenna ground plane. They are formed by spring tapes which in their stored position are wound over one another to form a cylinder and in their free position extend radially outward (angular spacing 90°) to form the ground plane 6. It should also be noted that the entirety of FIG. 5 can be structured so as to fit within another housing (not shown) which gives this antenna its pop-up characteristic.

While the present invention was designed primarily for military applications it may be envisioned for a variety of communication applications due to its broadband characteristics, compact storage, light weight, low fabrication cost, and capability of being deployed automatically. Additionally numerous variations and modifications of the present invention are possible in light of the above teachings. The configuration, type of coupling, the number of systems, type of ground plane, the dielectric, and the like can be changed within departing from the spirit and scope of the invention.

What I claim is:

1. A broadband hybrid monopole antenna which comprises:

a metal ground plane;

a metal inner conductor feed network passing through the ground plane and extending approximately $\frac{1}{4}$ of the operating wavelength above the plane;

a metal outer conductor whose length is slightly less than $\frac{1}{4}$ of the operating wavelength, concentric with the inner conductor and capacitively coupled to the ground plane; and an rf input with one conductor electrically coupled to the input end of the inner conductor for feeding electromagnetic energy into the inner conductor and the second conductor electrically coupled to the ground plane, wherein electromagnetic energy is capacitively coupled to the outer conductor.

2. The antenna as set forth in claim 1 wherein the capacitive coupling is achieved through a dielectric which is air.

3. The antenna as set forth in claim 1 wherein the capacitive coupling is achieved through a solid dielectric.

4. The antenna as set forth in claim 3 which also comprises a dielectric spacer inserted at the input end of the antenna.

5. The antenna as set forth in claim 4 which also comprises a dielectric spacer inserted at the open end of the antenna between the inner and outer conductors.

6. The antenna as set forth in claim 3 wherein the inner conductor is part of a coaxial transmission line.

7. The antenna as set forth in claim 6 wherein the outer conductor has a flange at the base.

8. The antenna as set forth in claim 3 wherein the outer conductor comprises a tapered helical spring with overlapping elements which forms a tapered tube when extended.

9. The antenna as set forth in claim 8 wherein the inner conductor comprises a tapered helical spring with overlapping elements which forms a tapered tube when extended.

10. The antenna as set forth in claim 1 wherein the ground plane is a flat metal surface.

11. The antenna as set forth in claim 1 wherein the ground plane comprises horizontal radials.

12. The antenna as set forth in claim 11 wherein the horizontal radials comprise spring-steel tapes which in their compressed position are wound over one another to form a cylinder and in their free position extend radially outward to form the ground plane.

* * * * *